United States Patent [19]

Finsterwalder et al.

[11] 3,977,350

[45] Aug. 31, 1976

[54] TANK SHIP, ESPECIALLY LIQUIFIED GAS TANK SHIP

[75] Inventors: Ulrich Finsterwalder, Munich-Obermenzing; Klemens Finsterwalder, Socking, near Starnberg, both of Germany

[73] Assignee: Dyckerhoff & Widmann Aktiengesellschaft, Munich, Germany

[22] Filed: Dec. 5, 1974

[21] Appl. No.: 529,921

[30] Foreign Application Priority Data

Dec. 8, 1973 Germany ..... 2361224

[52] U.S. Cl. ..... 114/74 A; 114/65 A

[51] Int. Cl.[2] ..... B63B 5/14

[58] Field of Search ..... 114/65 A, 74 R, 74 A

[56] References Cited

UNITED STATES PATENTS

| | | | |
|---|---|---|---|
| 3,457,890 | 7/1969 | Rivas et al. | 114/74 A |
| 3,498,249 | 3/1970 | Jones et al. | 114/65 A |
| 3,631,831 | 1/1972 | Sutherland | 114/65 A |
| 3,671,315 | 6/1972 | Larossi | 114/74 A |
| 3,828,708 | 8/1974 | Gerwick et al. | 114/74 R |

*Primary Examiner*—Duane A. Reger
*Assistant Examiner*—Gregory W. O'Connor
*Attorney, Agent, or Firm*—Frank L. Durr; Orville N. Greene

[57] ABSTRACT

The tank ship is made of monolithic reinforced concrete and is formed with two symmetrical, longitudinal chambers for tanks, and an intermediate space for the operating mechanisms thereof. The massive reinforced concrete slabs which form the ship are reinforced partly by prestressed steel tendons and partly by mild (non-stressed) steel rods. The prestressed tendons running lengthwise of the ship are unspliced. The transverse bulkheads forming the ends of the tanks are curved in two directions, e.g. in the form of sections of hemispheres. Insulation is provided on the interior surface of the tank chambers and on both sides of the bulkheads.

3 Claims, 11 Drawing Figures

TANK SHIP, ESPECIALLY LIQUIFIED GAS TANK SHIP

The invention relates to a tank ship especially for liquefied gas, such as LNG (liquefied natural gas), made with a monolithic hull of reinforced concrete and which possesses at least two longitudinal tank chambers extending side by side with respect to the cross-section of the hull.

Tank ships, for the transporting of liquefied gases must, if made of steel, be provided with special tanks for the liquefied gas for safety reasons, which are ordinarily constructed as spherical tanks. Aside from the fact that the available tank space in such ships cannot be fully taken advantage of, such ships are exceptionally expensive to manufacture and to maintain. Besides, one knows already that tank ships of reinforced concrete, compared with ships made from steel can be manufactured simpler and more economically.

The early art shows a tank ship consisting of a ship's body formed from two cylindrical bodies which intersect in the area of the longitudinal axis so that in cross-section three spaces are formed, from which the two outer spaces are used as tank spaces, and the middle one, the space formed by the overlap, becomes the operating space. (U.S. Pat. No. 1,313,529). The tank spaces are reinforced through straight bulkheads. Deck, bottom and hull sides of the ship are singly reinforced lengthwise and annularly. The longitudinal reinforcing rods are, when the hull is manufactured in individual sections, welded together at the joints. Additionally, vertical reinforcing rods are arranged in the vertical sections of both cylinders.

The use of reinforced concrete for the hull of liquefied gas tank ships is advantageous because the safety zone can be omitted whereas with steel ships, the arrangement of double hulls is specified. Concrete as a construction material, of course, does not undergo any decrease in strength if it should come into contact with the cold fluid in the event of an accident, but rather its strength is increased.

Liquefied gas ships are known, in which bottom, deck and hull sides consist of one or two shells of prefabricated panels of reinforced concrete, the panels being assembled at their edges and likewise connected to prefabricated beam type elements. (DT-OS 1,781,330 and 2,160,013). Bulkheads are also connected in this way. The individual parts are stressed with the aid of tendons utilizing high strength steel rods. On the inner side of the hull, an insulation against cold passage is arranged which is covered with a liner.

The object of this invention is to make a tank ship, especially a liquefied gas tank ship, which is simpler, more economical than the prior art ships, and which can be manufactured with improved efficiency of materials.

The invention achieves these objects in a tank ship of this type wherein the deck, the bottom and the hull sides consist of solid slabs which in length and cross-section with respect to the body of the ship, are reinforced partly with prestressed and partly with non-stressed reinforcements, wherein the non-stressed and stressed reinforcements consist of a cold ductile, high strength steel which at least partly is unspliced.

With the tank ship made according to the invention, the side panels of the hull consists, as seen structurally, in cross-section, of two three-dimensional half-frames consisting of the deck, hull sides and bottom, to which extremely large stress changes will be applied from the inner to the outer face, resulting from the pressure of the wave action. In the longitudinal direction, the hull exhibits a box girder whose length corresponds to the total length of the ship.

The main advantage of the invention lies in the construction of the deck, bottom and hull sides as a monolithic massive slab or plate of reinforced concrete. This slab or plate is reinforced partly by stressed and partly by non-stressed steel. The non-stressed reinforcement thereby operates alternately under compression and under tension, which in combination with the partially prestressed steel, has the advantage that the thickness of the solid slabs can be adjusted in such a way so that optimization of section properties can be achieved and the quantities and the light weight of the ship kept at a minimum.

Full prestressing, as used in prestressed concrete structures, by which the part of the dead weight outbalances the part of the live load, cannot be applied to ship hulls, since the dimensioning, based on the load case "compression and prestressing force" would require too great a cross-sectional size for the reinforced concrete, while the load case "tension and prestressing force" would not be utilized completely. The partial prestressing would be regulated in such a way that the reinforced concrete cross-section is exploited not only in the load case "tension and prestressing force" under tension, but also in the load case "compression and prestressing force" under compression.

Partial prestressing has scarcely been considered in the practice of making prestressed concrete structures. It will be treated as intermediate between a full or partly prestressing and a non-stressed reinforcing construction, both of which have their justifications and fields of application. In one case, freedom from cracks, and in another case, simplicity can be decisive. In the scope of the invention, the partial prestressing combined with the high percentage of non-stressed reinforcement has led to the developing of an advantageous construction, especially suitable for making ship hulls with a relatively low dead weight but high resistance against fatigue loading.

The constant curvature of the hull, at least a rounding off of the corners, has the advantage that reinforceing rods or tendons, which are rolled off of a coil into a straight alignment, can be curved elastically into the rounded corners, so that no splices of the reinforcing in the corners are necessary. Such splices would impair the fatigue strength of the reinforcing. For similar reasons, the longitudinal reinforcing is also arranged, essentially unspliced, over the total length of the hull.

If it is necessary to arrange bulkheads for reasons of floodability on tank ships made according to the invention, then it is practical to construct these as doubly curved shells.

With the tank ship of the invention, the bulkheads have only subordinate importance for the structural safety of the ship. It is limited thereupon, to equalize differential deflections of outer and inner walls, but which are small anyway, and to equalization along the length of the hull. Furthermore, they serve for the safety of the ship in case of unusual incidents like groundings, collisions, or damages resulting from war action.

The form of the bulkheads, as doubly curved shells, makes an easy construction possible, wherein the shell arch forms a shell member, together with the parts of the tank walls which are joined at the edge of the shell. This shell girder limits the floodability of the ship in case of a leak and it transfers the forces due to hydrostatic pressure in the longitudinal direction of the ship onto the cargo tank walls.

The advantage of the construction of the bulkhead as a doubly-curved shell also makes it possible to fit such tank ship for the transport of liquefied gas which is to be transported at a temperature of about −162°C.

For the transport of liquefied gas, insulation against cold passage is provided on the inner sides of the tank walls and on both sides of the bulkheads. In case of the outer hull walls, the temperature drop from the outside temperature to the cold temperature of the interior takes place almost completely in the insulation, whereas in the case of the bulkhead itself, it cannot be avoided that the concrete of the bulkheads cools down. The temperature drop takes place gradually from the hull walls down to a low point in the center of each bulkhead. Hence, a straight bulkhead would suffer an intolerable thermal stress. A doubly curved shell is however, not exposed to such stresses due to elastic deformation of the chamber of the shell.

The invention will be further explained by means of a drawing showing an embodiment thereof. In the drawing.

Figure 1:
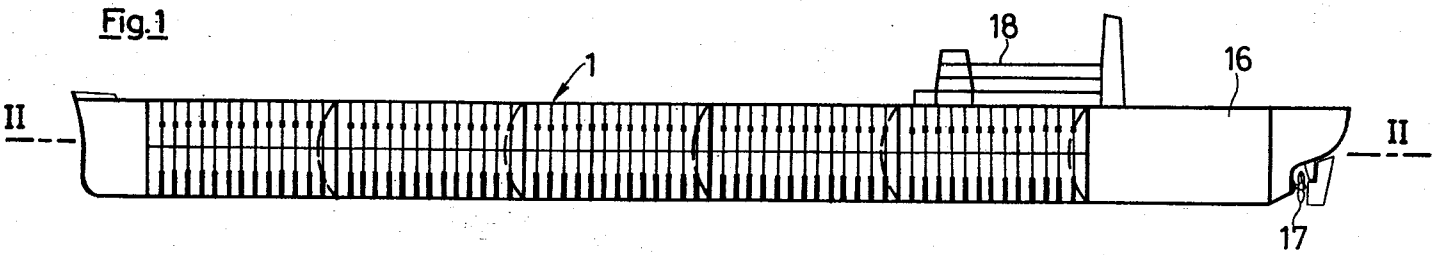
FIG. 1 is a longitudinal section of a tank ship made according to the invention taken through the longitudinal middle axis.
Figure 2:
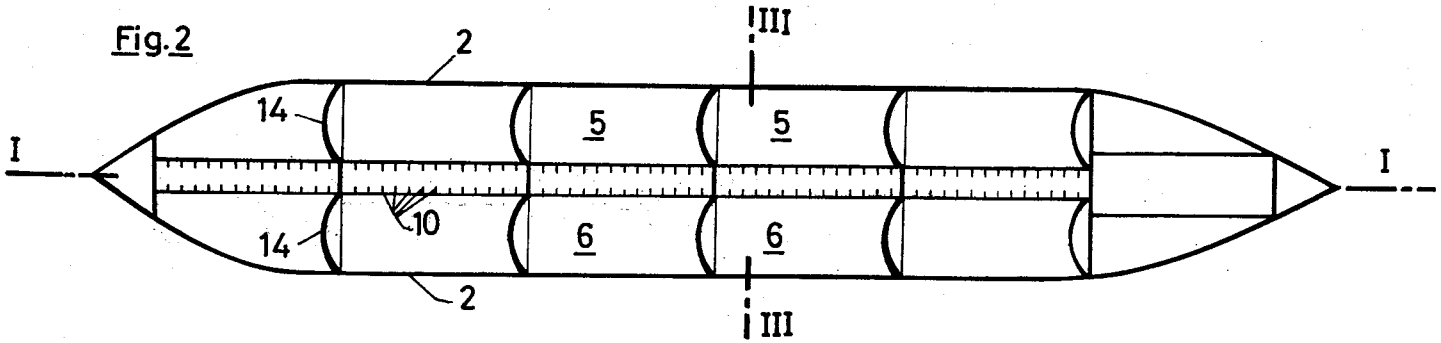
FIG. 2 is a horizontal section taken somewhat above the waterline.
Figure 3:
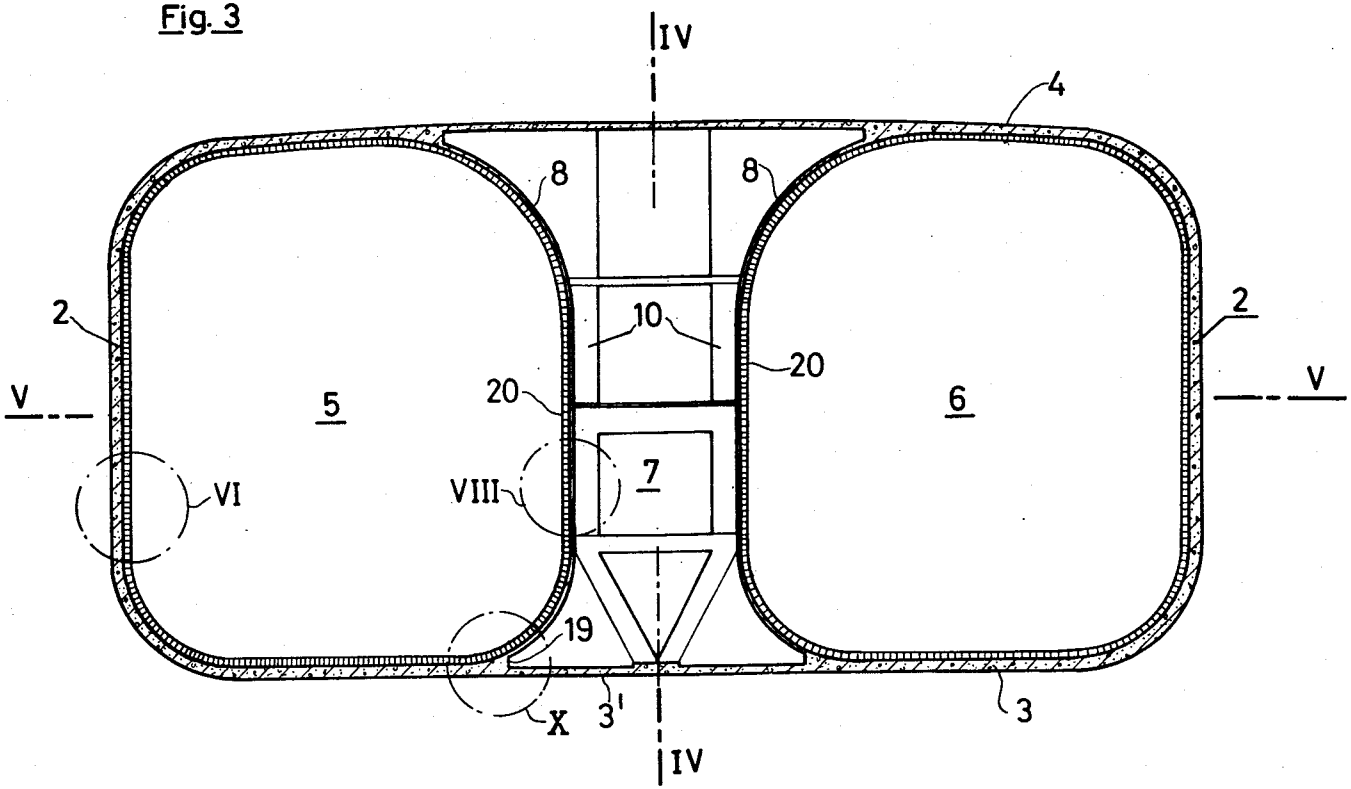
FIG. 3 is a cross-section taken along line III — III of FIG. 2, but on a larger scale.
Figure 4:
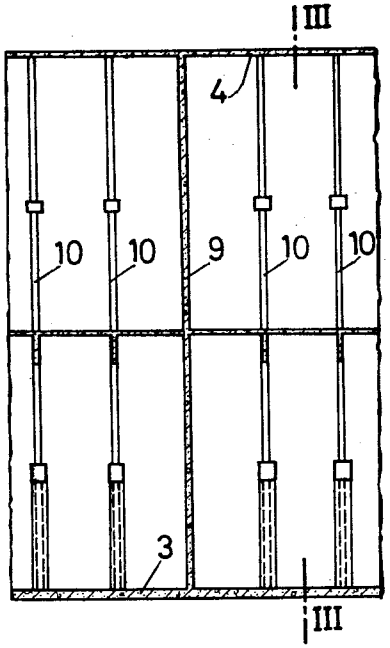
FIG. 4 is a partial view of a longitudinal section taken along line IV — IV of FIG. 3.
Figure 5:
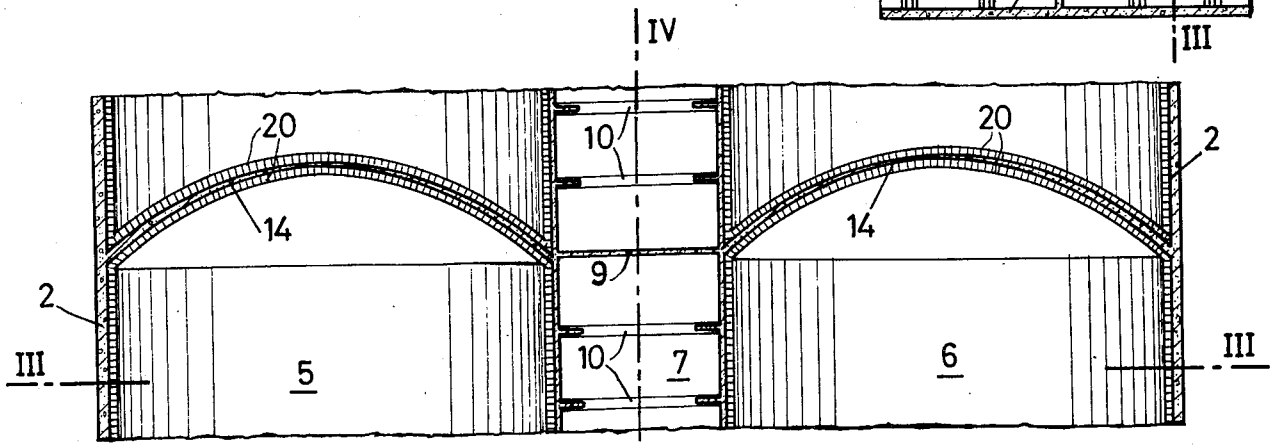
FIG. 5 is a horizontal section taken along V — V of FIG. 3.

In the embodiment shown in the drawing, the outer sidewalls 2, the bottom 3, and the deck 4 of the hull 1 of a tank ship consists of solid slabs made of reinforced concrete. The hull 1 has a somewhat rectilinear cross-section with considerably rounded-off edges. The rounding-off can be still more severe, so that the outer-wall 2 appears almost completely curved. The cross-section encloses three spaces 5, 6 and 7, which can be used as tank chambers (FIG. 3). The separating walls 8, extending along the center tank chamber 7 is like-wise formed as a slab, but can be thinner than the outer walls 2, since the inner chamber 7 is supported at small intervals through bulkheads 9 and ribs 10 (FIG. 5).

The hull sides 2, and the bottom 3, and the deck 4 are partially prestressed and reinforced to a high percentage by mild steel. The direction and arrangement of the reinforcing steel is illustrated in FIGS. 6–11.

Figure 7:
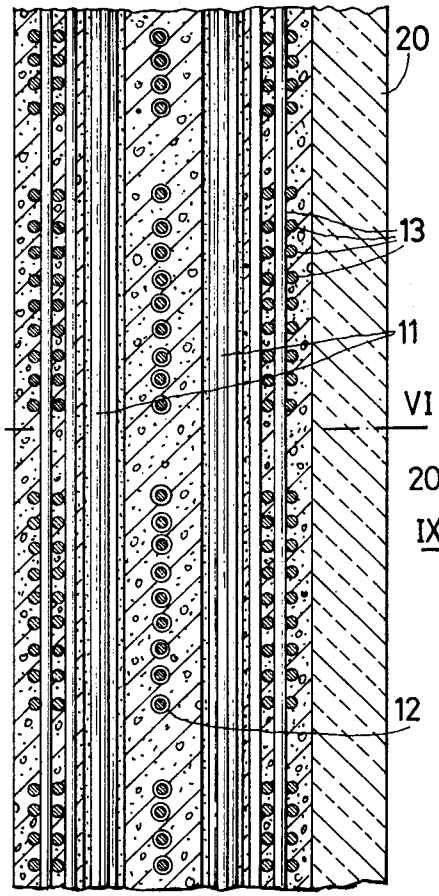
FIG. 7 is a sectional view taken along line VII — VII of FIG. 6.
Figure 6:
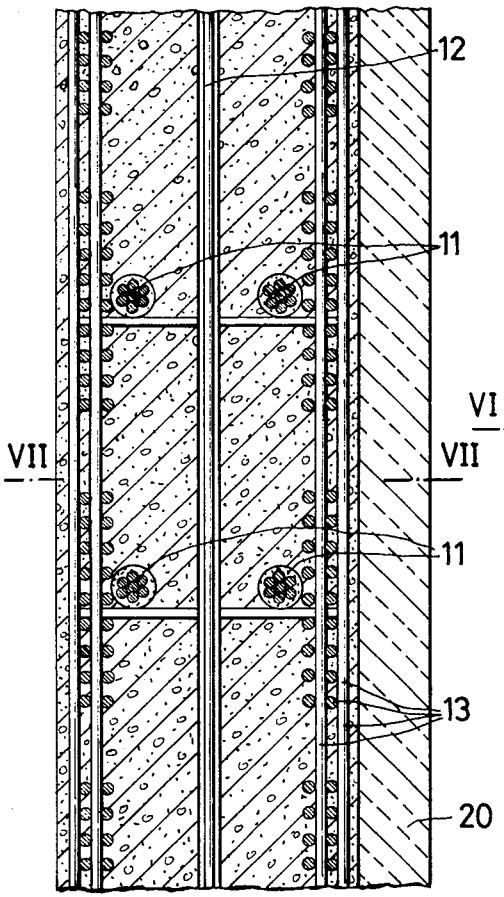
FIG. 6 is a view on an enlarged scale of the circled portion VI of FIG. 3.

FIG. 6 shows a vertical cross-section of the cut-out region VI of FIG. 3 greatly enlarged. FIG. 7 shows a horizontal section thereof. In the longitudinal direction of the hull 1, the longitudinal prestressing tendons as the prestressing reinforcement runs along both sides of the middle plane of the wall. Therebetween, the vertically extending transverse prestressing tendons 12 are arranged. The longitudinal tendons 11 are shown as a bundle made of a plurality of individual elements, in order to attain a higher prestressing force then with the single prestressing rods 12. The mild, i.e., non-prestressed reinforcement 13, in the form of steel rods in several layers are arranged in the outer areas of the cross-section.

Figure 9:
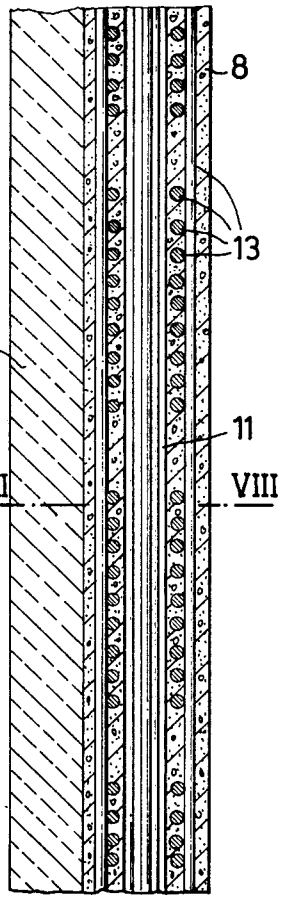
FIG. 9 is a sectional view taken along line IX — IX of FIG. 8.
Figure 8:
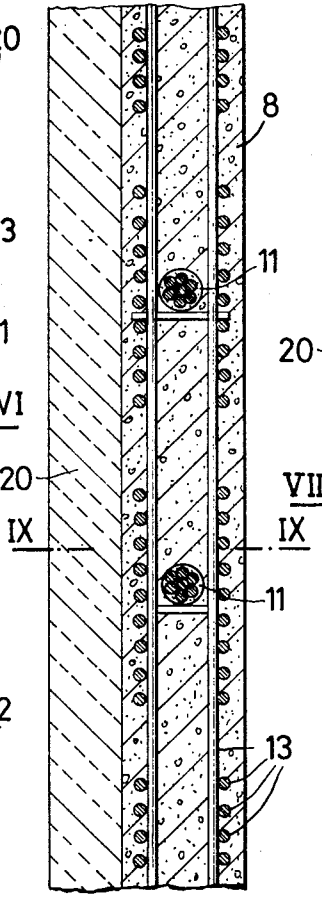
FIG. 8 is an enlarged view of the circled portion VIII of FIG. 3.
Figures 10, 11:
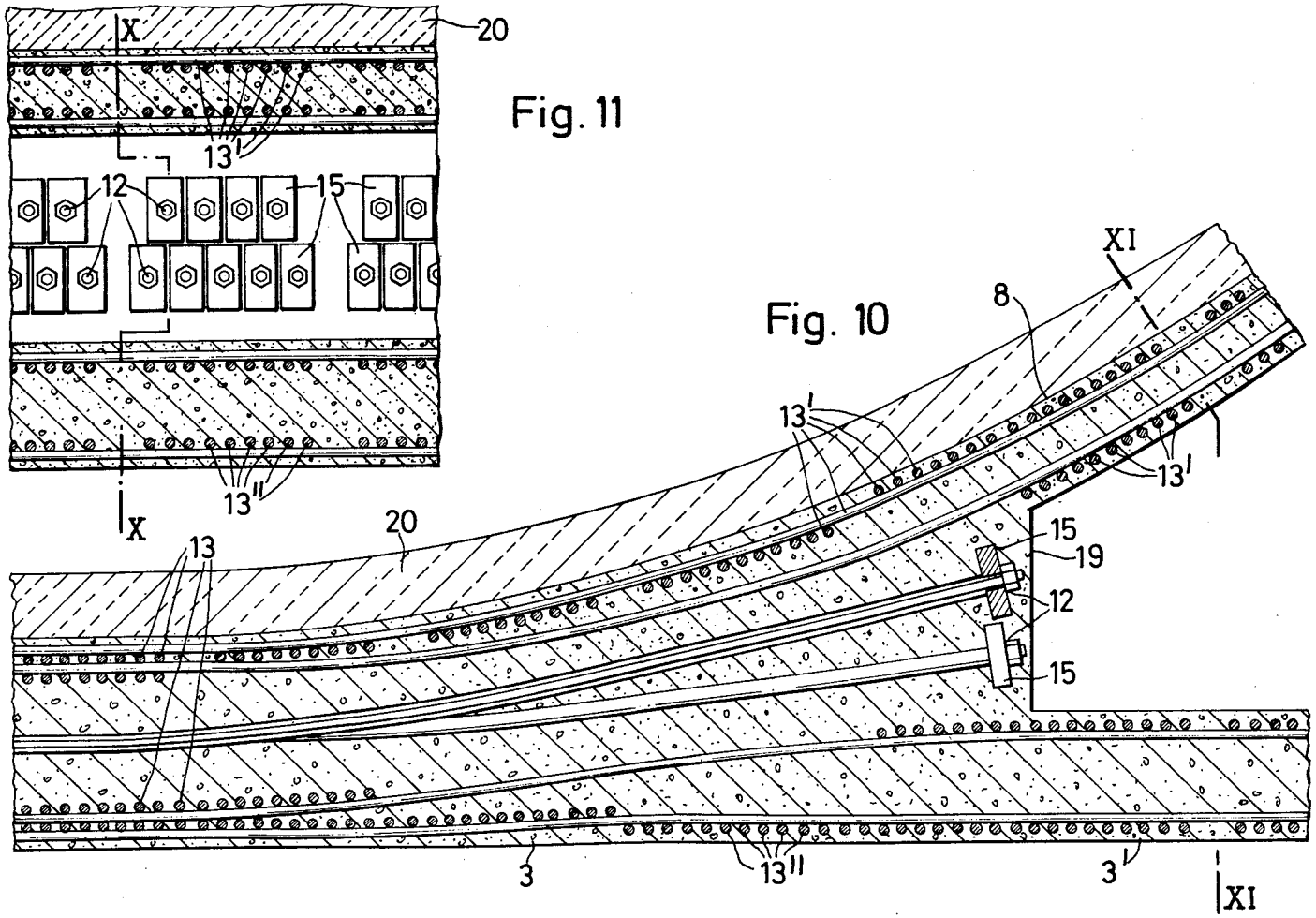
FIG. 10 is an enlarged view of the circled portion X of FIG. 3 with the reinforcement at the transition from the bottom to the inner wall.
FIG. 11 is a section taken along line XI — XI of FIG. 10.

The reinforcing of the inner walls 8 is shown in FIGS. 8 and 9 in a corresponding way. Here the longitudinal prestressing tendons lie in the area of the middle plane of the wall, while the mild or single reinforcements 13 are arranged close to the outer sides. The prestressed transverse reinforcement is lacking here; as shown in FIGS. 10 and 11, it is anchored in the transition portion of the bottom or deck to the inner walls.

In the zone of these transitions, the prestressing tendons 12 of the transverse reinforcement are anchored in a wedge 19 with the customary anchoring means 15, while the mild reinforcements 13′ are incorporated into the inner side of the bottom of the inner wall 8 and the mild reinforcements 13″ remains in the outer side of the bottom 3 to continue in the intermediate portion 3′ of the bottom of the tank ship. The prestressing tendons for the longitudinal reinforcings are not shown here in order to simplify the drawings. FIG. 11 is another view of the anchoring means.

All reinforcing elements can be made of a high strength steel, for example, ST 135/150, diameter = 16 mm., which is supplied in coils in lengths of 250 m. or more so that it can be installed without splicing over great lengths. At temperatures as low as −200°C. this steel is still ductile. This steel can, based on its strength and its surface deformations (it is provided on the surface with a profile in the form of ribs) be employed as well for the mild reinforcing as for the prestressing tendons. It can be employed as the material of the single rod, as e.g., the transverse prestressing tendon 12, and also for the individual elements in the bundle of the longitudinal prestressing tendons 11, which for example, can consist of seven such rods.

This steel exhibits a fatigue strength of 30 Kg/mm$^2$ when the stress changes vary from 0 to 30 Kg/mm$^2$, in comparison with a fatigue strength of 24 Kg/mm$^2$, when the basic stress, achieved by prestressing of the steel is 70 Kg/mm$^2$. This different fatigue strength is being allowed for in such a way that, as mentioned, the mild reinforcements will always extend along the outer sides of the plates, in the location of the greatest stress changes, while the prestressing reinforcement is arranged in the inner region of the slabs where the stress change fluctuations are correspondingly less.

Depending on the portion of the prestressed reinforcement in the total reinforcement, hence on the amount of prestressing force, the longitudinal tendons 11 can be concentrated in the outer wall 2, also in the middle plane of the wall and the transverse tendons 12 can be moved nearer the mild reinforcements.

The bulkheads 14 in the region of the outer tanks 5 and 6 are formed as double-curved shells, They have, in the example, the form of sections of hemispheres, and are connected at their outer edges (at the abutment) with the wall thickness of each tank.

The embodiment of tank ship shown is suitable for the transporting of liquefied gas. To this end, the outer tank chambers 5 and 6 are provided with an insulation 20 on the inner sides and the formed bulkheads 14 are provided with insulation 20 on both sides. The intermediate tank chamber 7 is destined for ballast water for trimming the ship.

The proper hull 1 is streamlined. Space 16 is provided in the stern for the driving apparatus, a ship's propeller 17, and for the apparatus for preservation of the temperatures as well as the usual superstructure 18 above the deck.

We claim:

1. A tank ship especially suited for transporting liquefied gas comprising a monolithic hull essentially rectilinear in shape but with rounded edges and comprising bottom, sides and deck formed of monolithic slabs of reinforced concrete which proceed into one another in regular curvature, said slabs being reinforced longitudinally and transversely partly by stressed and largely by non-stressed profiled steel reinforcing rods, extending continuously along substantially the entire length and breadth of said slabs, at least two longitudinally-extending interior wall means of reinforced concrete connected to the deck and bottom of said ship to provide at least two longitudinally extending tanks therein, said tanks being divided by bulkheads of reinforced concrete spaced along the length of said tanks and extending transversely of said ship to form tank chambers, said bulkheads being of such a number to provide safe floodability of said ship, said bulkheads being formed of double curved shells in the regions passing through said tank chambers, and a layer of insulation on the interior of said tank chambers.

2. The tank ships as claimed in claim 1 wherein at least a portion of the stressed and non-stressed steel reinforcing rods consists of high strength steel having relatively high ductility at cold temperatures.

3. The tank ship as claimed in claim 1 wherein the stressed, longitudinal reinforcing rods extend the full length of the monolithic slabs and are unspliced along their entire length.

* * * * *